US005943797A

United States Patent [19]

Yoder et al.

[11] Patent Number: 5,943,797

[45] Date of Patent: Aug. 31, 1999

[54] EXCAVATING MACHINE WITH CONVEYOR ASSEMBLY

[75] Inventors: Shaun Lamar Yoder; Steven J. Ditzler, both of Wellman, Iowa

[73] Assignee: Samson Enterprises, Inc., Wellman, Iowa

[21] Appl. No.: 08/782,626

[22] Filed: Jan. 13, 1997

[51] Int. Cl.[6] ..... E02F 5/06

[52] U.S. Cl. ..... 37/359; 37/352

[58] Field of Search ..... 37/305, 304, 306, 37/359, 360, 93, 95, 369, 373, 374, 107, 392, 463, 352, 353, 355, 190; 198/860.1, 860.3, 860.2, 860.5, 806, 837, 841

[56] References Cited

U.S. PATENT DOCUMENTS

| | | | |
|---|---|---|---|
| 1,698,152 | 1/1929 | Cole | 37/392 |
| 3,052,050 | 9/1962 | Wilms et al. | 37/190 |
| 3,082,858 | 3/1963 | King | 198/841 |
| 3,280,487 | 10/1966 | Thomas et al. | 37/190 |
| 3,540,139 | 11/1970 | Gethmann et al. . | |
| 3,610,691 | 10/1971 | Pemote et al. . | |
| 3,680,919 | 8/1972 | Rear et al. . | |
| 3,967,396 | 7/1976 | Maisonneuve et al. | 37/190 X |
| 3,967,854 | 7/1976 | Posciri . | |
| 3,994,083 | 11/1976 | Cunningham . | |
| 4,110,920 | 9/1978 | Brown . | |
| 4,179,829 | 12/1979 | Kinkade . | |
| 4,650,067 | 3/1987 | Brule | 198/860.3 X |
| 4,768,297 | 9/1988 | Rivard . | |
| 4,976,051 | 12/1990 | Kovalev et al. . | |
| 5,040,549 | 8/1991 | Ray | 198/860.1 X |
| 5,096,045 | 3/1992 | Feldl | 198/860.2 X |
| 5,115,908 | 5/1992 | Williams | 198/841 X |
| 5,144,760 | 9/1992 | McGuire . | |
| 5,203,101 | 4/1993 | Bryan . | |
| 5,228,220 | 7/1993 | Bryan, Jr. | 37/190 X |
| 5,333,399 | 8/1994 | Mett . | |
| 5,375,347 | 12/1994 | Fleischhaker . | |
| 5,381,616 | 1/1995 | Disney . | |

OTHER PUBLICATIONS

Undated brochure entitled "All Hydrostatic Buckeye 7200" of H & S Co., Inc. (No Date).

Undated brochure entitled "Trenchless Plows Dynapac–Hoes 623/624/784" of Dynapac–Hoes GmbH; (No Date).

Undated brochure entitled "Drainage Machine Hoes Gigant 1800"of Dynapac Hoes Trencher Division; (No Date).

Undated brochure entitled "Trencher Dynapac–Hoes 3000" of Dynapac–Hoes GmbH (No Date).

Undated brochure entitled "Drainage Machine Hoes Gigant 3000" of Dynapac Hoes Trencher Division (No Date).

Undated brochure entitled "High Productivity Trencher & Plows" of Dynapac–Hoes GmbH (No Date).

Undated brochure entitled "Eagle 4500 Wheel Trencher" of Eagle Trencher Corporation (No Date).

Undated brochure entitled "Port Industries, Inc. Hydramaxx 2400" of Port Industries, Inc. (No Date).

(List continued on next page.)

*Primary Examiner*—Thomas B. Will
*Assistant Examiner*—Robert Pezzuto
*Attorney, Agent, or Firm*—Brian J. Laurenzo; Michael C. Gilchrist

[57] ABSTRACT

An excavating machine is provided having an improved conveyor assembly, the excavating machine having a power unit, a supporting frame assembly operably attached to the power unit, an earth cutting device operably attached to the supporting frame assembly, and a conveyor assembly operably attached to the supporting frame assembly for expelling from the excavating machine the spoil created by the earth cutting device. The conveyor assembly has an interior portion bounded by a first end roller and a second end roller, an endless conveyor belt about the first end roller and the second end roller, a first side assembly and a second side assembly, all to prevent the spoil from entering the interior portion of the conveyor assembly.

20 Claims, 20 Drawing Sheets

OTHER PUBLICATIONS

Undated brochure entitled Tesmec USA, Inc. TRS–1175–D6/ TRS–1175–D7 Chainsaw and Rocksaw Specifications of Tesmec, USA, Inc. (No Date).

Undated brochure entitled "RWF Bron Self–Propelled Trenchers and Plows" of RWF Bron No Date.

Undated brochure entitled "Samson 3700RS"of Samson Enterprises, Inc.

Aug., 1994 brochure entitled "T–455" of Vermeer Manufacturing Company. No Date.

1994 brochure entitled "T–755 Hydrostatic Trencher with T.E.C. 2000" of Vermeer Manufacturing, Inc. (No Date).

1995 brochure entitled"V–8550 Hydrostatic Trencher/ Plow" of Vermeer Manufacturing Company (No Date).

1995 brochure entitled "T–655DT Hydrostatic Trencher with T.E.C. 2000" of Vermeer Manufacturing Company (No Date).

Sept., 1991 brochure entitled "T–655" of Vermeer Manufacturing Company (No Date).

1994 brochure entitled "In Five Hours He'll Go From Gumbo to Limestone to Caliche. And Do Nothing About It. Introducing T.E.C. 2000" of Vermeer Manufacturing Company (No Date).

EXCAVATING MACHINE WITH CONVEYOR ASSEMBLY

BACKGROUND OF THE INVENTION

The invention relates generally to excavating machines of the type having a device for cutting the earth including, but not limited to, bucket wheel trenchers, chain bar trenchers, trencher or trenchless plows and hoes, vibratory plows, disc wheel cutters, drum cutters, etc., and more particularly to a conveyor assembly for expelling from the excavating machine the spoil created by the earth cutting means.

Excavating machines are well known for use in the cutting of an open trench having either vertical or sloped walls for the purposes of land drainage and irrigation including agricultural tiling, as well as the installation of utilities such as cable lines, pipelines, water lines, sewer lines, etc. These excavating machines are often of a vehicular type being self-contained and suitably driven for either over-the-road travel or movement during use of the earth cutting device.

Typically, the excavating machines of the prior art have used a conveyor assembly comprising an endless conveyor belt about a largely open frame having a series of rollers therein. As the spoil falls onto the conveyor assembly, it can get into the interior portion of the assembly clogging the series of rollers and causing other damage. In order to prevent this problem, other prior art devices have incorporated steel, plastic or hard rubber deflection shields to keep the spoil on top of the endless conveyor belt. The problem with these deflection shields is that they cause premature wear and damage to the top or edges of the endless conveyor belt. As the belt wears, spoil can penetrate the interior portion of the conveyor assembly between the deflection shield and the belt.

The difficulties encountered in the prior art discussed hereinabove are substantially eliminated by the present invention.

SUMMARY OF THE INVENTION

Accordingly, it is an object of the present invention to provide an excavating machine having an improved conveyor assembly for expelling the spoil from the excavating machine to a spoil bank beside the machine.

An additional object of the present invention is to provide an excavating machine with a conveyor assembly having a closed interior portion which is free from spoil.

It is another object of the present invention to provide an excavating machine with a conveyor assembly having fewer rollers which can become clogged.

It is still another object of the present invention to provide an excavating machine with a conveyor assembly having an endless conveyor belt which is free from contact with deflection shields which can cause premature wear and damage.

It is a further object of the present invention to provide an excavating machine which can be operated more efficiently.

An additional object of the present invention is to provide an excavating machine with a conveyor assembly having closed sides to prevent spoil from entering the interior portion of the conveyor assembly.

A further object of the present invention is to provide an excavating machine having a low profile conveyor assembly which is easy to maintain.

A further object of the present invention is to provide an excavating machine having a conveyor assembly with means for keeping an endless conveyor belt centered thereon.

Other features and advantages of the present invention will become apparent upon a review of the following description, drawings and claims.

By the present invention, it is proposed to overcome the difficulties encountered heretofore. To this end, an excavating machine is provided having an improved conveyor assembly, the excavating machine having a power unit; a supporting frame assembly operably attached to the power unit; earth cutting means operably attached to the supporting frame assembly; and a conveyor assembly operably attached to the supporting frame assembly for expelling from the excavating machine the spoil created by the earth cutting means, the conveyor assembly comprising an interior portion bounded by a first end roller and a second end roller opposite the first end roller, an endless conveyor belt about the first end roller and the second end roller, a first side assembly and a second side assembly opposite the first side assembly, all to prevent the spoil from entering the interior portion of the conveyor assembly.

In the preferred embodiment, the conveyor assembly further comprises a top plate of ultra-high molecular weight plastic on which the endless conveyor belt slides, the top plate which extends laterally to overlap the first side assembly and the second side assembly. Finger-like projections on the underside of the endless conveyor belt correspond to a groove on the top plate and in tapered end rollers to assist in keeping the endless conveyor belt centered on the conveyor assembly.

DETAILED DESCRIPTION OF THE INVENTION

Figure 1:
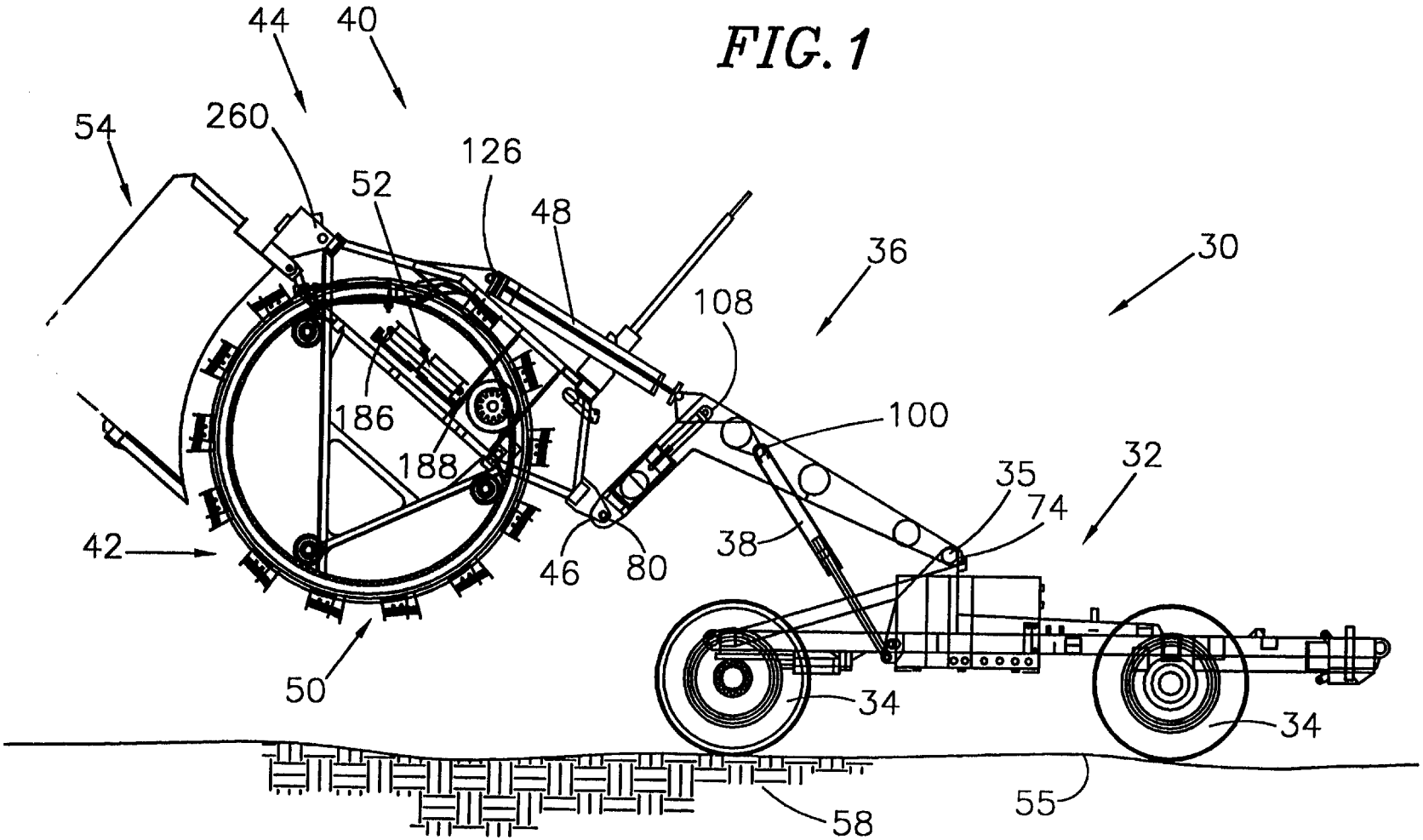
FIG. 1 is a front elevational view of an excavating machine with its earth cutting means in a raised position in accordance with the present invention.

Referring to FIG. 1, the numeral 30 generally designates the excavating machine of the present invention. The excavating machine 30 includes a power unit vehicle 32 supported by wheels 34. Pivotally mounted about a horizontal axis 35 on the power unit vehicle 32 is an L-arm assembly 36 which is adapted to be raised and lowered by means of a hydraulic cylinder 38. Pivotally mounted to the L-arm assembly 36 are earth cutting means 40. The earth cutting means 40 of the preferred embodiment comprise a bucket wheel trencher assembly 42 but, alternatively, could comprise a chain bar trencher, a trencher or trenchless plow or hoe, a vibratory plow, a disc wheel cutter, a drum cutter or any other earth cutting device. The earth cutting means 40 comprise a supporting frame assembly 44. The supporting frame assembly 44 is pivotally mounted about a horizontal axis 46 as part of a means for controlling the pitch of the earth cutting means 40, and this pivotal movement is controlled by a second hydraulic cylinder 48. Rotatably mounted to the supporting frame assembly 44 is a wheel assembly 50. Also mounted to the supporting frame assembly 44 are a conveyor assembly 52 and a shoe assembly 54.

Figure 2:
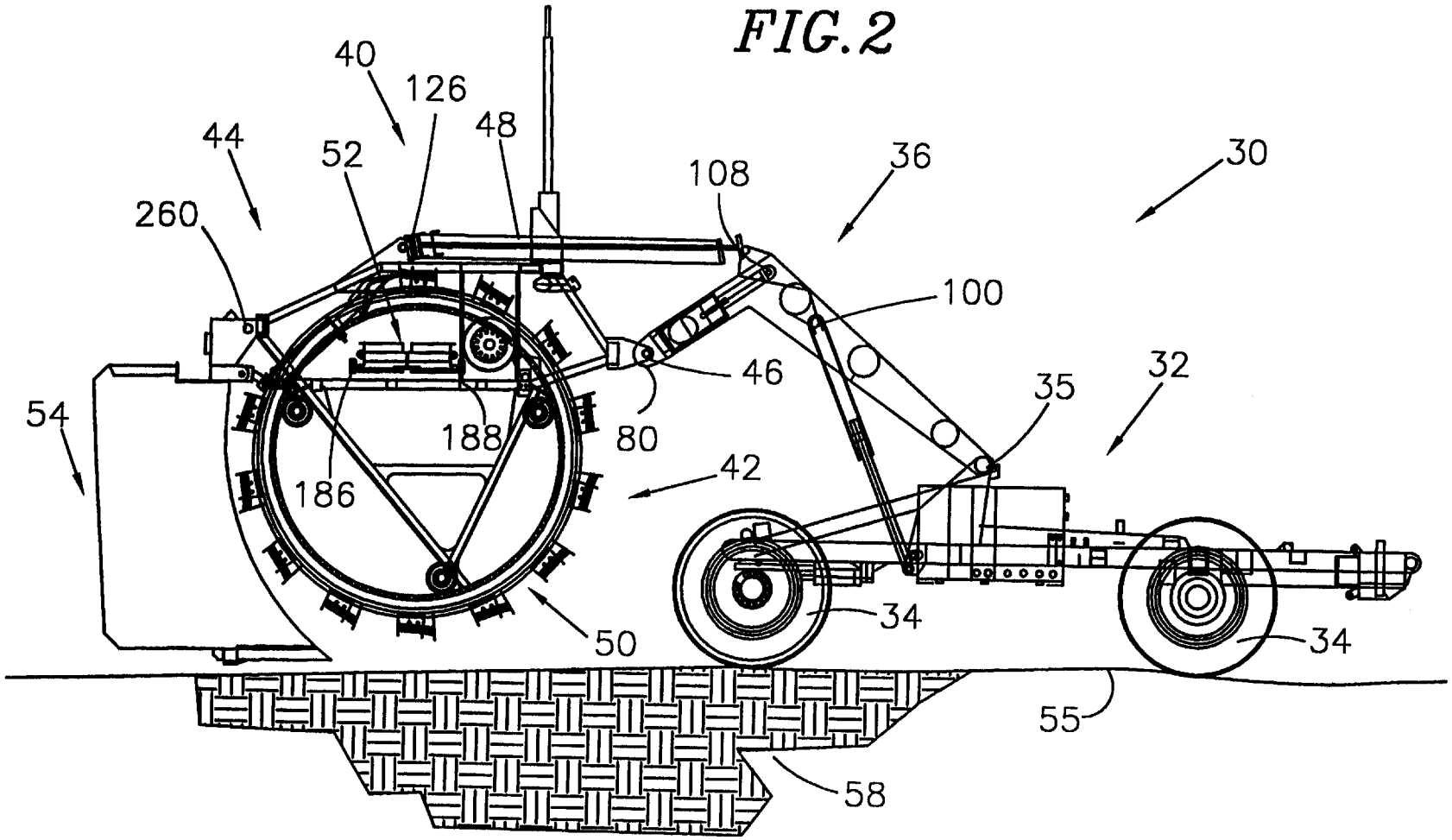
FIG. 2 is a front elevational view of the excavating machine shown in FIG. 1 with its earth cutting means at ground level.
Figure 3:
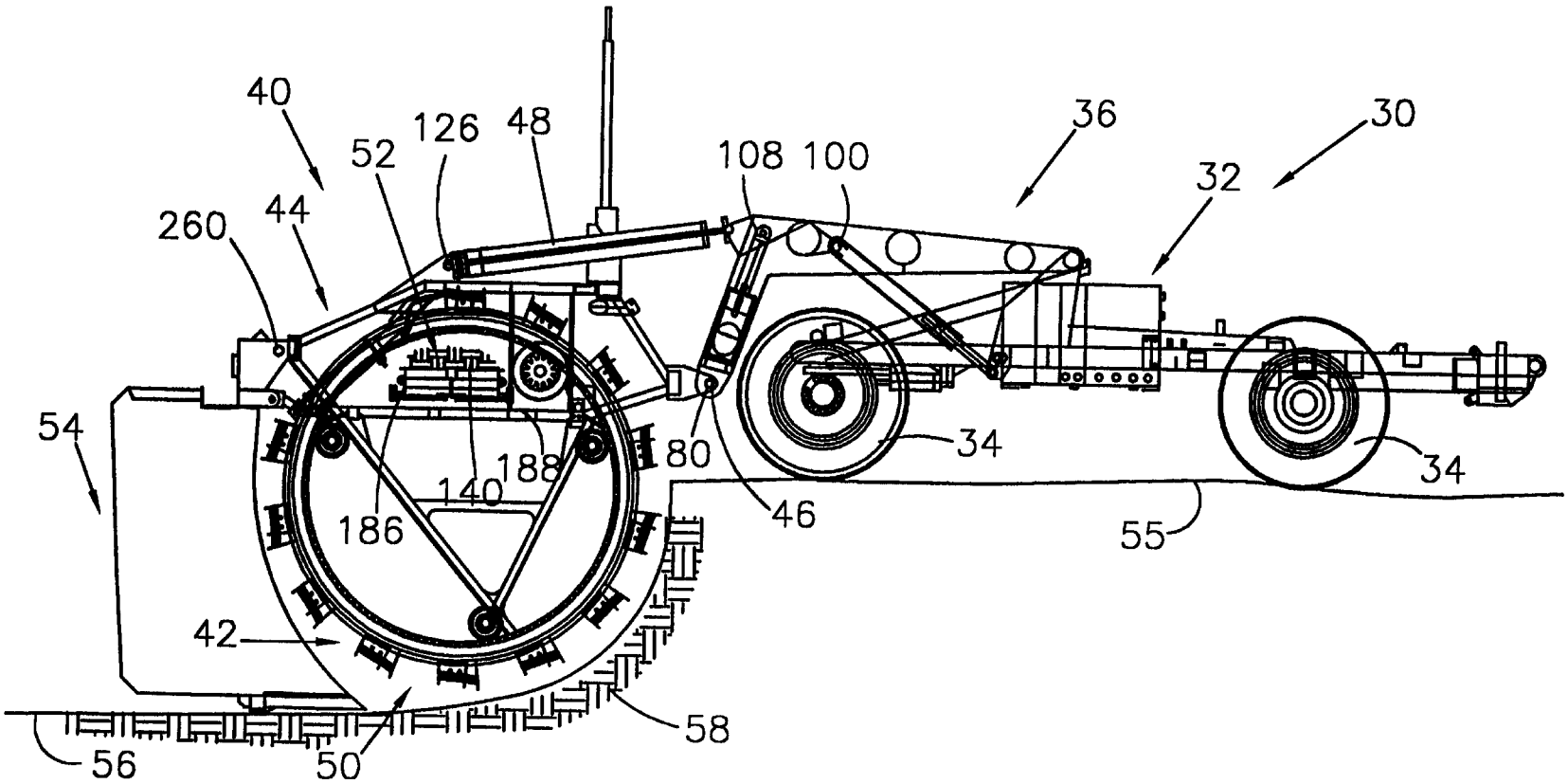
FIG. 3 is a front elevational view of the excavating machine shown in FIG. 1 with its earth cutting means partially below ground level.
Figure 4:
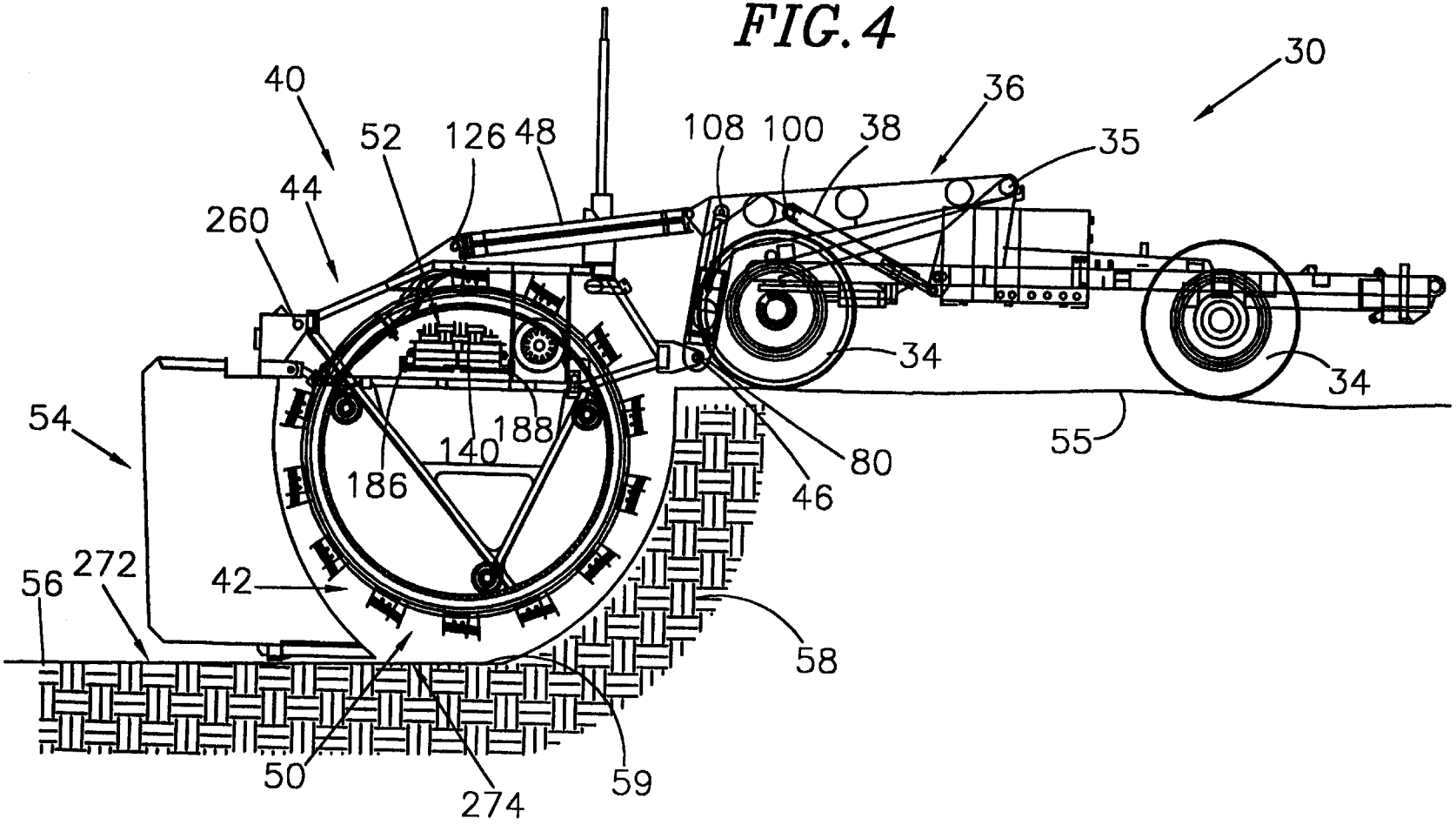
FIG. 4 is a front elevational view of the excavating machine shown in FIG. 1 with its earth cutting means at the bottom of a trench.

FIGS. 1–4 schematically show the excavating machine 30 in its range of positions. FIG. 1 shows the earth cutting means 40 in a fully raised position. FIG. 2 shows the earth cutting means 40 lowered to ground level 55. FIG. 3 shows the earth cutting means 40 partially below ground level 55 as a trench 56 in the ground 58 is begun. FIG. 4 shows the earth cutting means 40 in a position at the bottom 59 of the trench 56 in the ground 58.

FIGS. 5–8 show the improved means for raising and lowering the earth cutting means 40 which comprise the L-arm assembly 36. The L-arm assembly 36 is located between the power unit vehicle 32 and the earth cutting means 40. The L-arm assembly 36 includes a first arm 60 having a first end 62 and a second end 64 opposite to the first end 62. The L-arm assembly 36 further includes a second arm 66 integral with and substantially transverse to the first arm 60. The second arm 66 has a first end 68 integral with the first end 62 of the first arm 60 and a second end 70 opposite to the first end 68 of the second arm 66. The second end 64 of the first arm 60 includes apertures 72 for receiving a pivot member 74 for pivotal attachment to the power unit vehicle 32. The second end 70 of the second arm 66 includes an extended lift member 76 having an apertures 78 for receiving a pivot member 80 for pivotal attachment to the supporting frame assembly 44 about horizontal axis 46. The first arm 60 of the L-arm assembly 36 is longer than the second arm 66 of the L-arm assembly 36.

Figure 5:
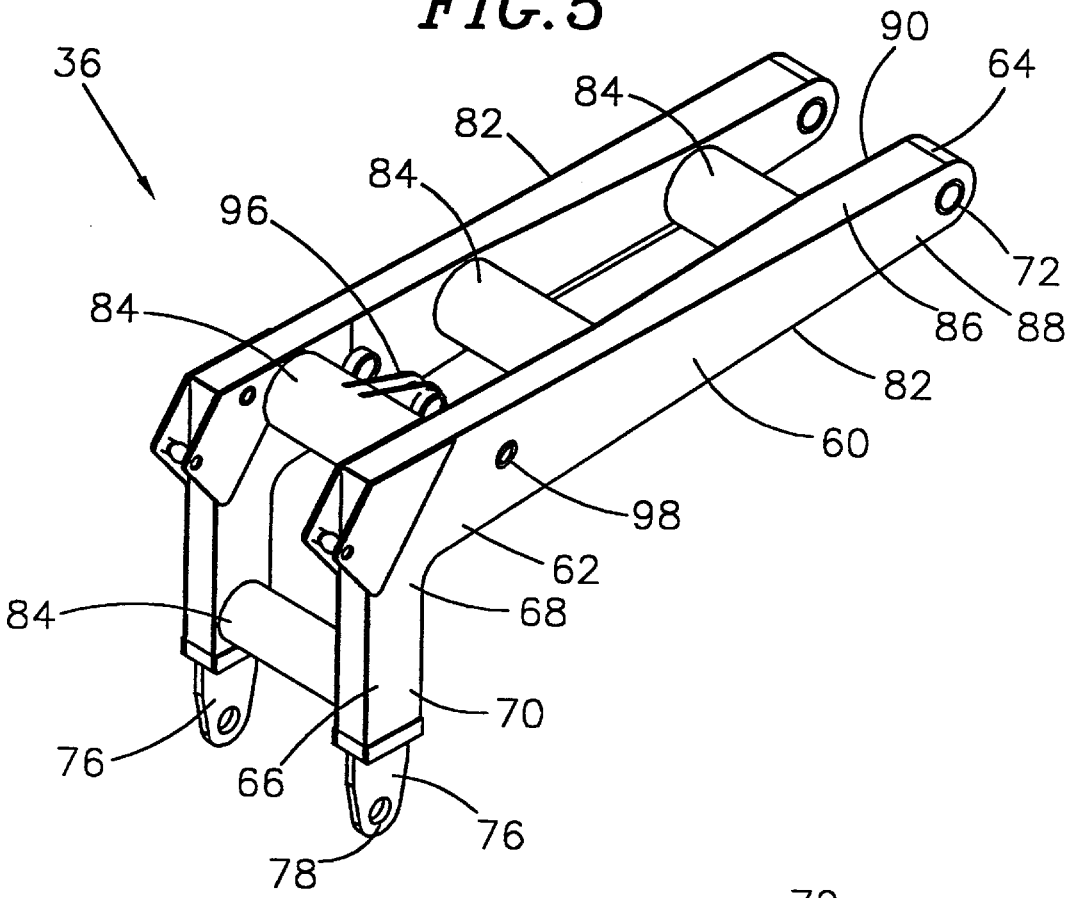
FIG. 5 is a top perspective view of an L-arm assembly in accordance with the present invention.
Figure 6:
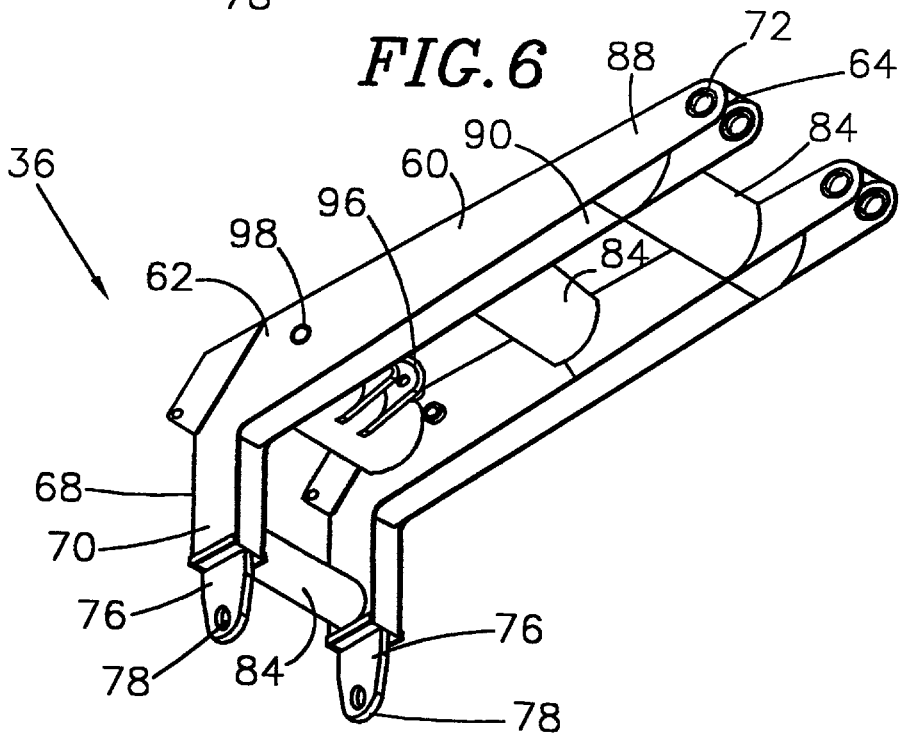
FIG. 6 is a bottom perspective view of the L-arm assembly shown in FIG. 5.

While it is anticipated that the L-arm assembly 36 could comprise one L-arm of solid construction (not shown), the preferred embodiment as shown in FIGS. 5 and 6 show an assembly of two separate L-arms 82 spaced apart by tubular support members 84. In addition, FIGS. 5 and 6 show that the first arm 60 of each L-arm 82 is comprised of a top plate 86 and first and second side plates 88 and 90, respectively, the first side plate 88 being substantially parallel with the second side plate 90 with a slight divergence between the first side plate 88 and second side plate 90 from the first end 62 of the first arm 60 to the second end 64 of the first arm 60. In addition, the second arm 66 of each L-arm 82 is comprised of a rectangular housing 94 with the extended lift members 76 extended from the second end 70 thereof.

The L-arm assembly 36 also includes means for attachment to the hydraulic cylinder 38 to raise and lower the L-arm assembly 36 in the form of two gusset plates 96 having apertures 98 therein for receiving a pivot member 100 for pivotal attachment to the hydraulic cylinder 38. It is preferred that these means for attachment to the hydraulic cylinder 38 be proximate to the first end 62 of the first arm 60 of the L-arm assembly 36.

Figure 7:
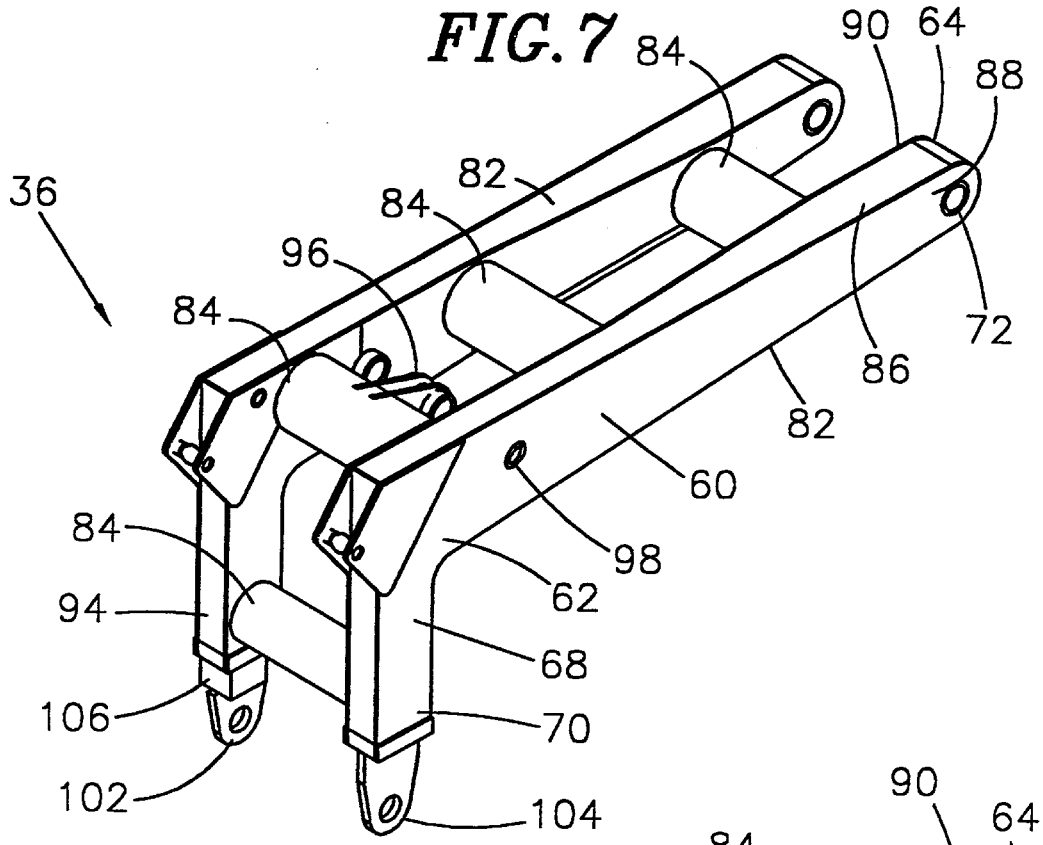
FIG. 7 is a top perspective view of the L-arm assembly showing a slidable leg member in its extended position.
Figure 8:
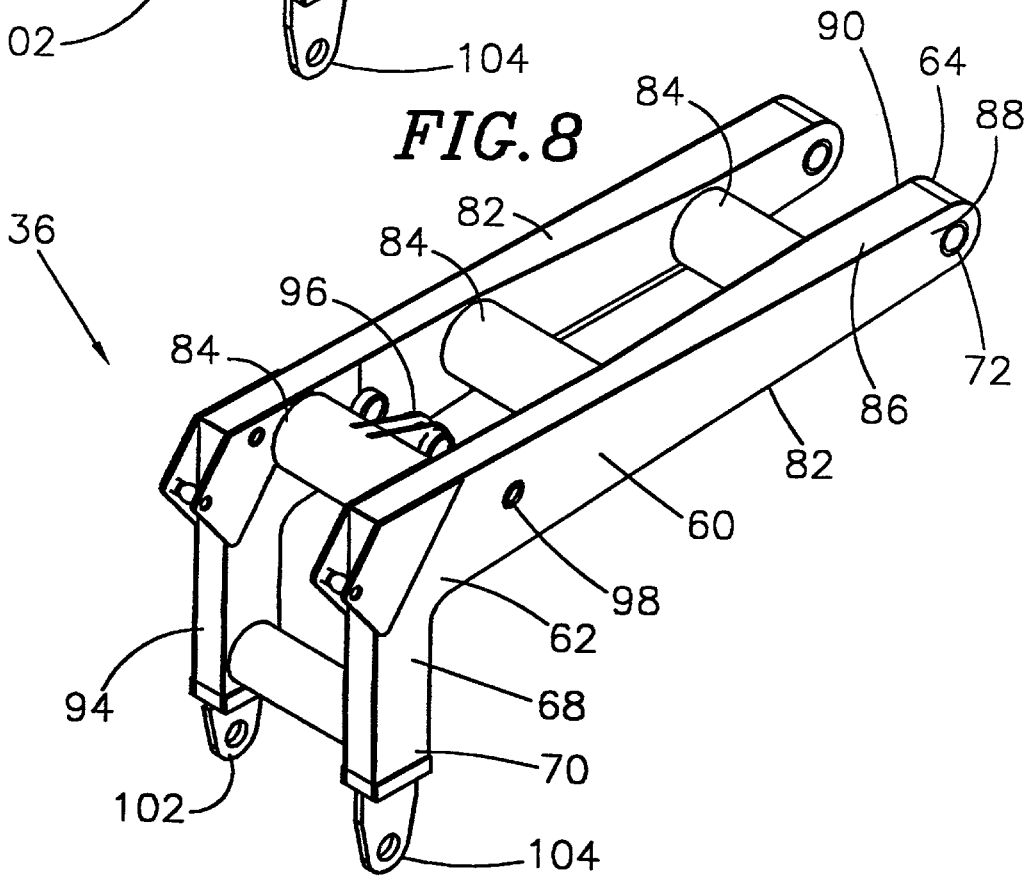
FIG. 8 is a top perspective view of the L-arm assembly shown in FIG. 7 showing the slidable leg member in its retracted position.

In the preferred embodiment wherein the L-arm assembly 36 is made up of two parallel L-arms 82, one of the parallel second arms 66 includes within its rectangular housing 94 means for extending and retracting the extended lift member 76 means for extending and retracting an extended lift member 102 relative to a rigidly connected extended lift member 104 are shown in FIGS. 7 (extended) and 8 (retracted). A telescoping housing 106 is operably attached between a linear actuator 108 (shown uncovered in FIGS. 1–4) and the lift member 102. The L-arm assembly 36 also includes mounting flanges 110 having apertures 112 therein for operable attachment to the second hydraulic cylinder for controlling the pitch of the earth cutting means 40 through extension and retraction of same as shown in FIGS. 1–4.

While the L-arm assembly 36 of the present invention is shown on an excavating machine 30 having a bucket wheel trencher assembly 42, it is to be understood that this L-arm assembly 36 could be incorporated with any type of excavating machine having earth cutting means as original equipment or sold separately as a retrofit part for existing equipment.

Figure 9:
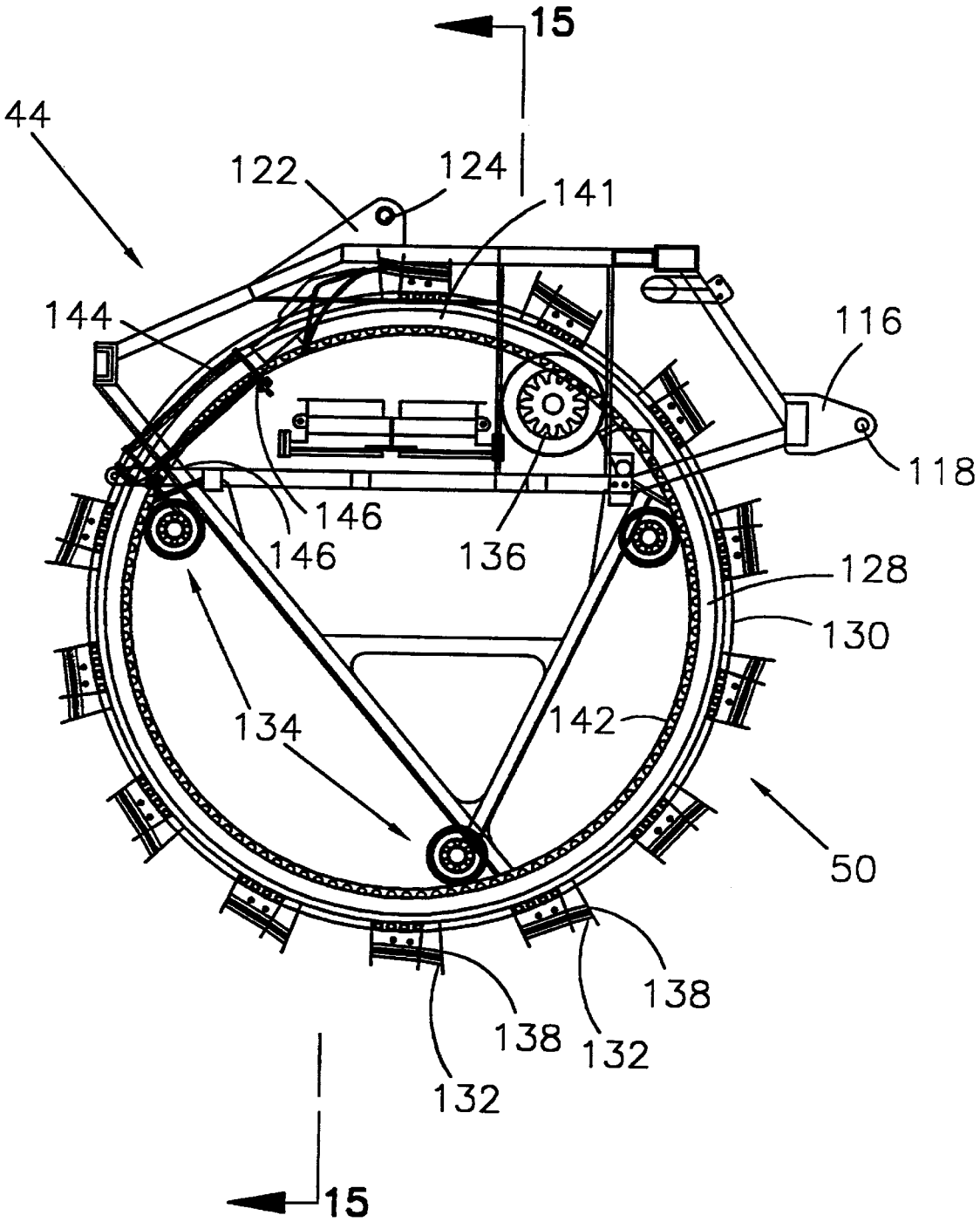
FIG. 9 is a front elevational view of the supporting frame assembly and the wheel assembly of the excavating machine shown in FIG. 1.
Figure 10:
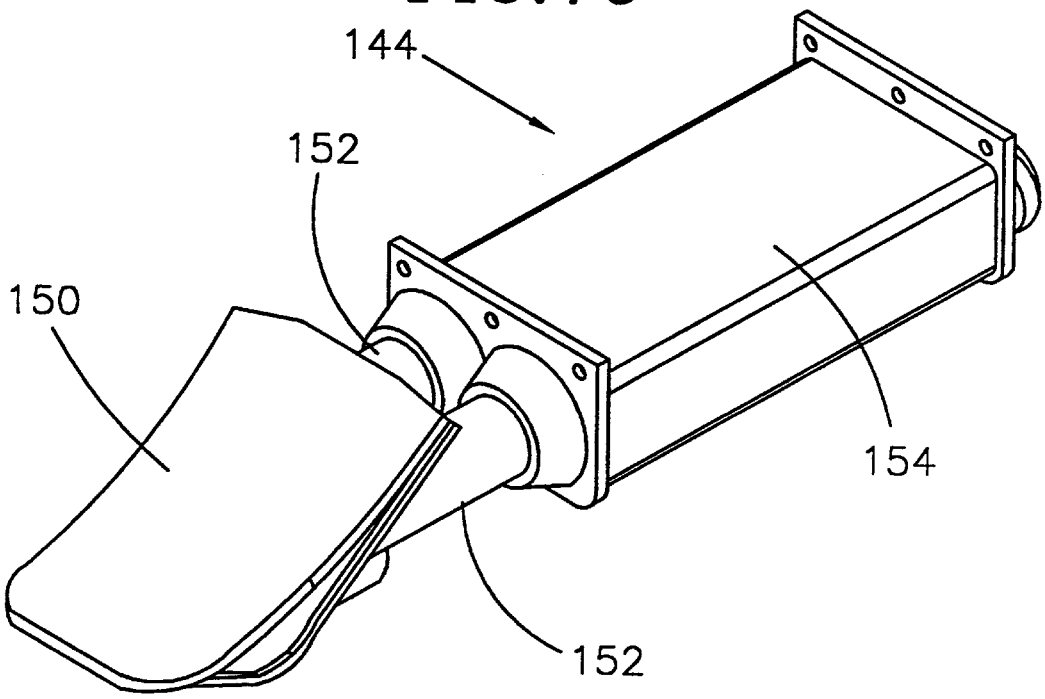
FIG. 10 is a bottom perspective view of a cleaning member in accordance with the present invention.
Figure 11:
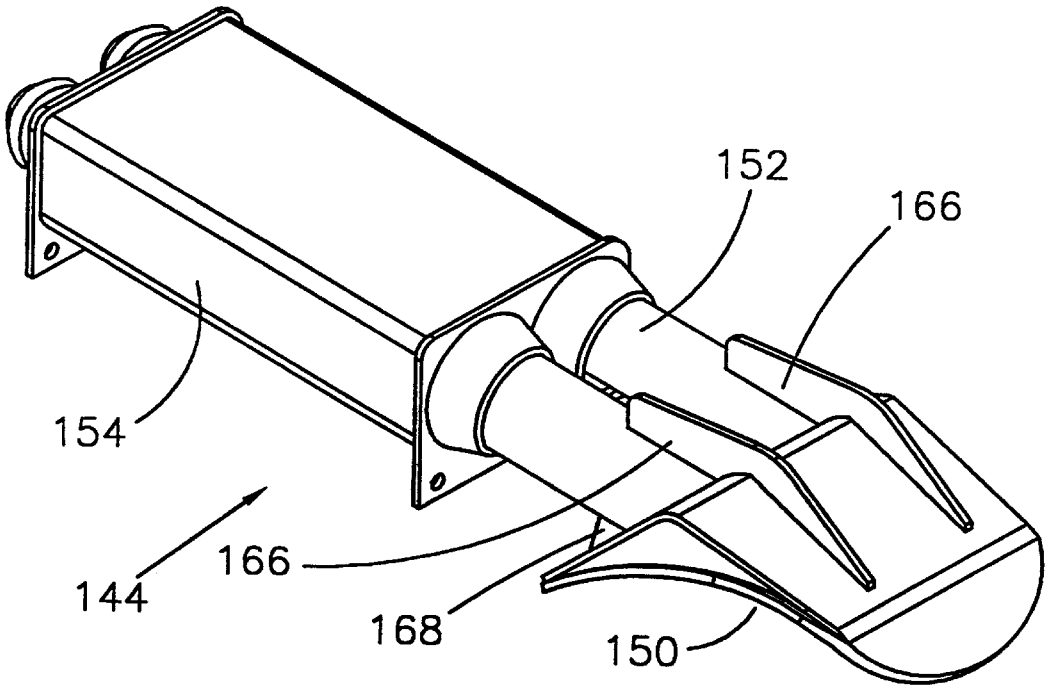
FIG. 11 is a top perspective view of the cleaning member shown in FIG. 10.
Figure 12:
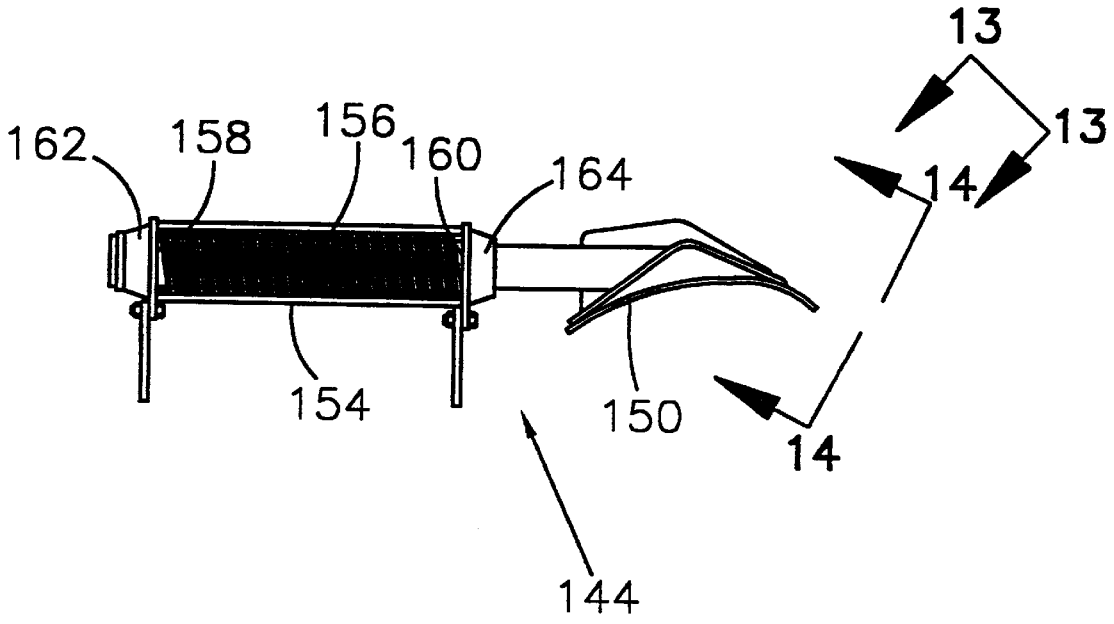
FIG. 12 is a front elevational view of the cleaning member shown in FIG. 10 partially in cross-section.
Figure 13:
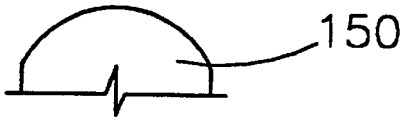
FIG. 13 is a view of the cleaning member shown in FIG. 12 taken along lines 13—13.
Figure 14:
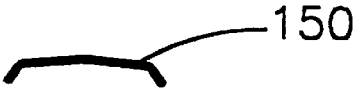
FIG. 14 is a sectional view of the cleaning member shown in FIG. 12 taken along lines 14—14.

FIG. 9 shows an enlarged elevational view of the supporting frame assembly 44 and the wheel assembly 50 mounted rotatably thereon. A hitch 116 having an aperture 118 therein is included for receiving pivot member 46 for pivotal attachment to the second end 70 of the second arm 66 of the L-arm assembly 36. In addition to pivotal movement upon extension or retraction of the hydraulic cylinder 48, when the slidable lift member 102 is extended or retracted relative to the fixed lift member 104 by linear actuator 108, the supporting frame assembly 44 and the wheel assembly 50 are adjustable from their normal vertical orientation. This is beneficial when a vertical trench is to be dug on uneven ground or when a non-vertical trench is to be dug.

The supporting frame assembly 44 also includes a flange 122 having an aperture 124 therein for receiving a fastening member 126 for operable attachment to the second hydraulic cylinder 48 for the supporting frame assembly 44. Accordingly, as the second hydraulic cylinder 48 for the wheel frame assembly 44 is extended and retracted, the pitch of the supporting frame assembly 44 is adjusted up or down in accordance therewith.

The wheel assembly 50 includes a digging wheel 128 having a rim structure 130 and a series of circumferentially spaced bucket members 132 peripherally extended from the rim structure 130 of the digging wheel 128. A truck roller assembly 134 is rigidly connected to the supporting frame assembly 44 for adjustment of the digging wheel 128 and to maintain the digging wheel 128 in a desired position. The digging wheel 128 is driven in a counter-clockwise direction by a drive mechanism 136. As the digging wheel 128 rotates, a leading edge 138 of the bucket member 132 excavates a portion of spoil 140 which is then carried by the bucket member 132 and the rim structure 130 to the top 141 of the digging wheel 128. An arc plate 142 keeps the spoil from passing through the rim structure 130 until it reaches the top 141 of the digging wheel 128 where it then falls onto the conveyor assembly 52 for expelling laterally to a spoil bank (not shown) on the side of the excavating machine 30.

Figure 15:
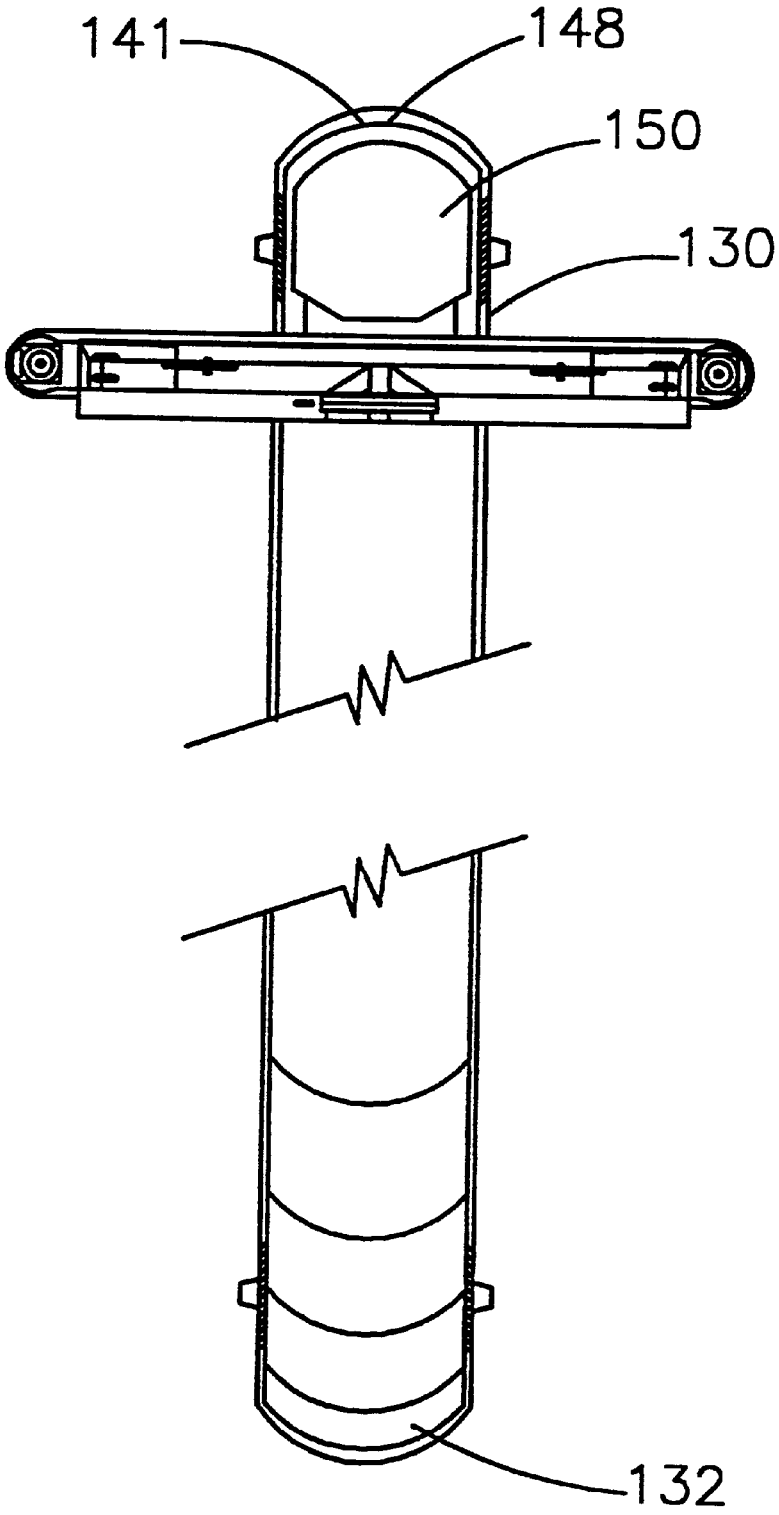
FIG. 15 is a partial cross-sectional elevational view of the wheel assembly shown in FIG. 9 taken along lines 15—15.

An improved cleaning member 144 is operably attached to the wheel frame assembly 44 at 146. The cleaning member 144 is shown in detail in FIGS. 10–14 and as positioned within an interior profile 148 of the rim structure 130 and the bucket member 132 of the digging wheel 128 in FIG. 15. The cleaning member 144 is positioned at an angle with a cleaning face 150 located at the top 141 of the digging wheel 128 in such a manner that it removes the spoil which has accumulated in the rim structure 130 and the bucket member 132 of the digging wheel 128 and directs the spoil 140 downwardly onto the conveyor assembly 52. The cleaning face 150 corresponds substantially in size and shape to the interior profile 148 of the rim structure 130 and the bucket member 132, the cleaning face 150 thereby fitting within the interior profile 148 of the rim structure 130 and the bucket member 132 to remove substantially all of the spoil 140 which has accumulated therein when the rim structure 130 and the bucket member 132 come into contact with the cleaning face 150.

The cleaning face 150 is arcuate in lateral cross-section (FIG. 14) and in longitudinal cross-section (FIG. 12) resulting in a concave shape in order to deflect the spoil 140 downward. Support gussets 166 and 168 are included to strengthen the cleaning face 150.

In the preferred embodiment, the cleaning face 150 is rigidly attached to a pair of support tube shafts 152 which pass through a housing 154 wherein coiled springs 156 are located between a mounting flange 158 and a washer 160. Bearing members 162 and 164 are located about the housing 154, which, along with the rest of the components of the cleaning member 144 allow the coil springs 156 to bias the cleaning face 150 into position within the interior profile 148 of the rim structure 130 and the bucket member 132 as well as to retract the cleaning face 150 upon contact with an obstruction (not shown) within the interior profile 148 of the rim structure 130 and the bucket member 132. This configuration allows for positive cleaning while preventing against damage upon contact with an obstruction.

Figure 16:
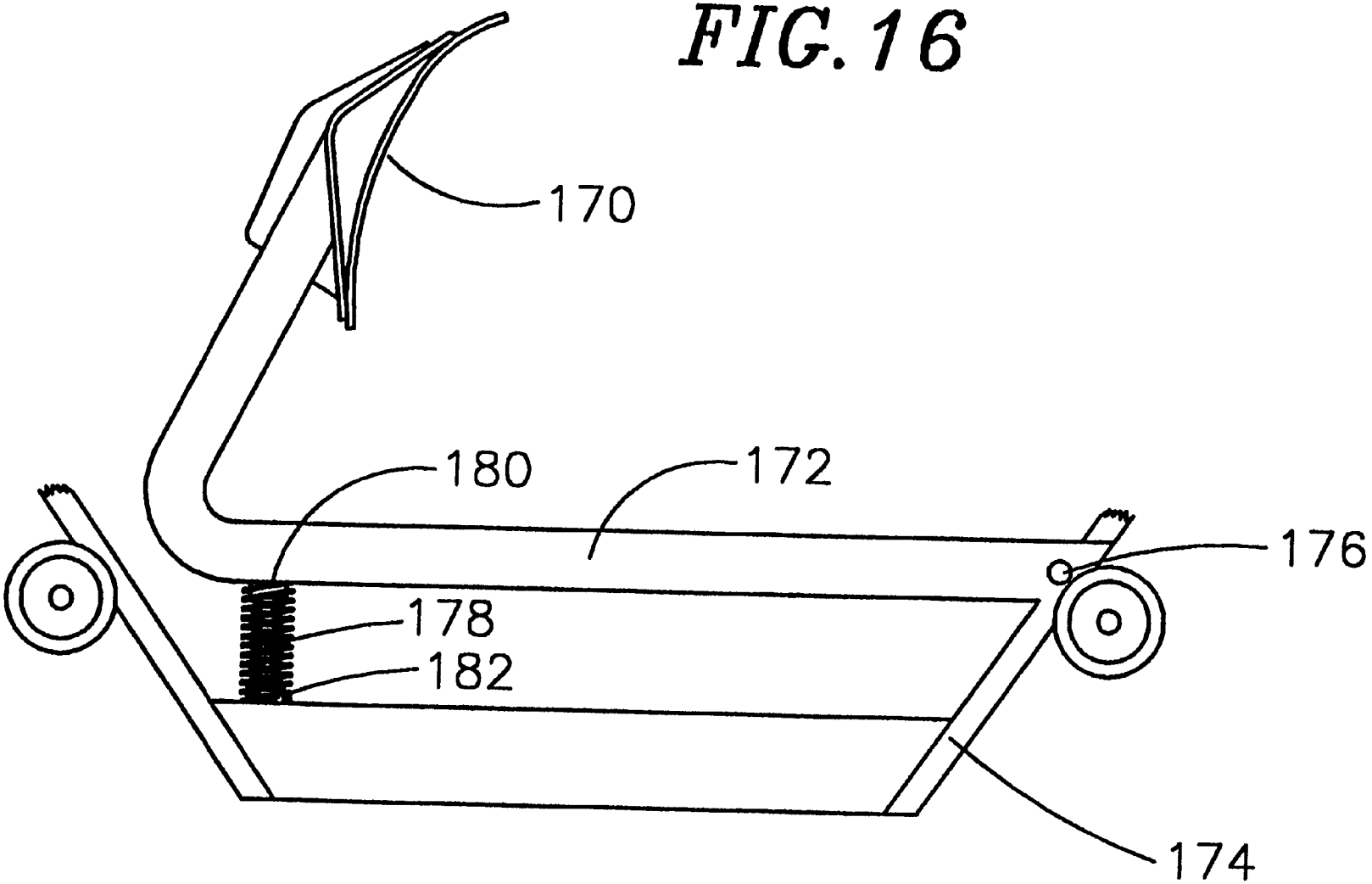
FIG. 16 is a front elevational view of an alternative cleaning member and wheel frame assembly in accordance with the present invention.
Figure 17:
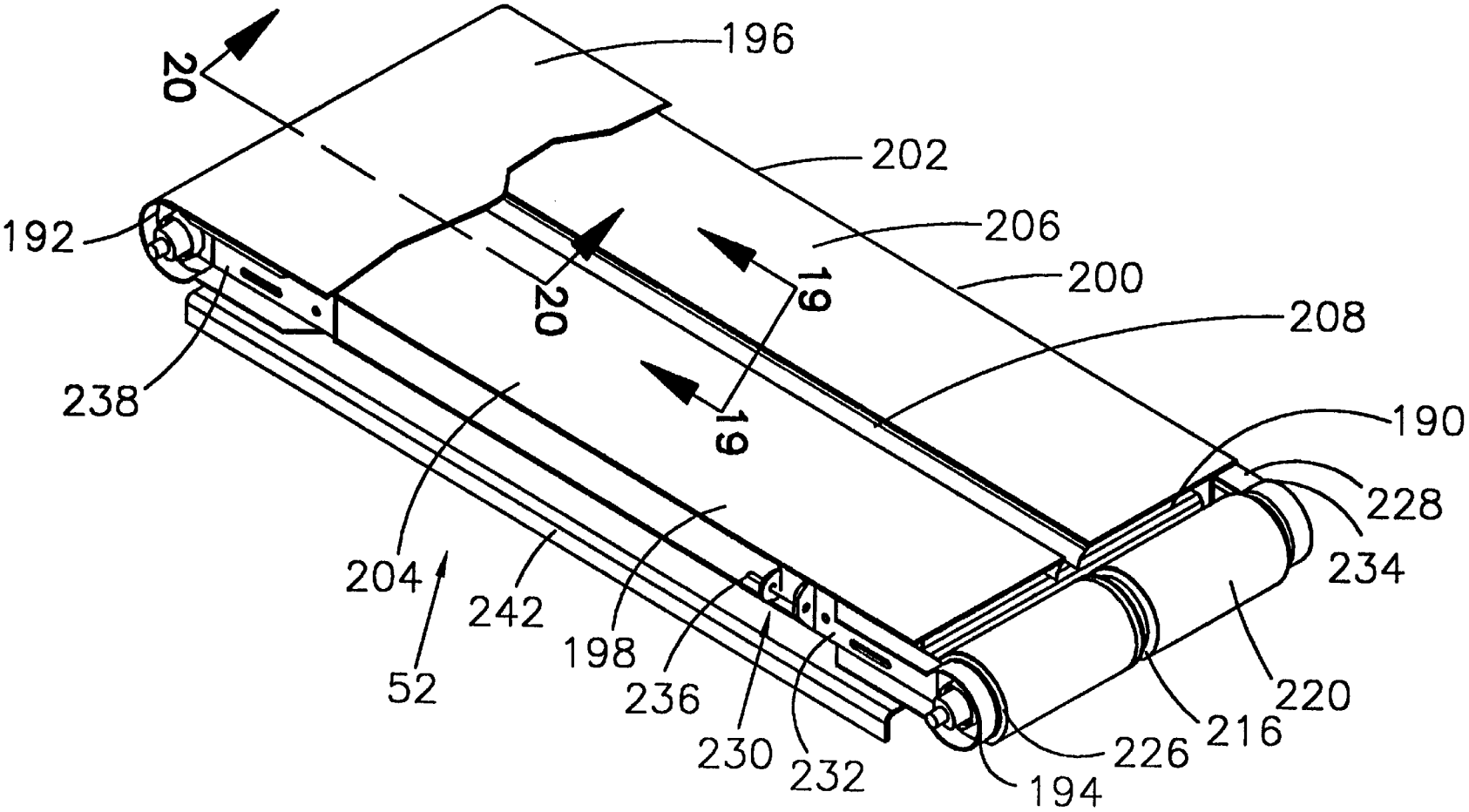
FIG. 17 is a top perspective view of a conveyor assembly with most of the endless conveyor belt removed in accordance with the present invention.
Figure 18:
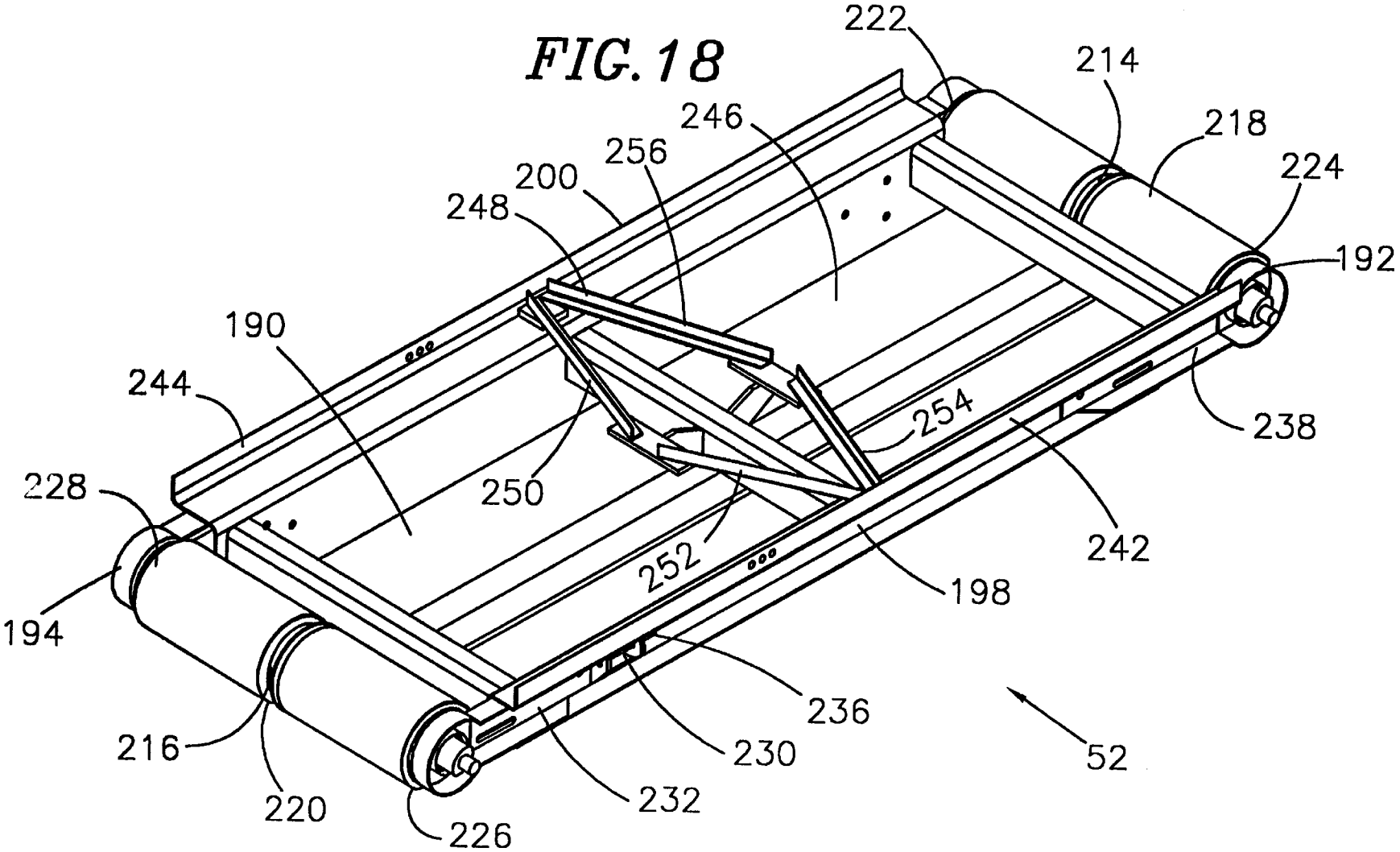
FIG. 18 is a bottom perspective view of the conveyor assembly shown in FIG. 17.
Figure 19:
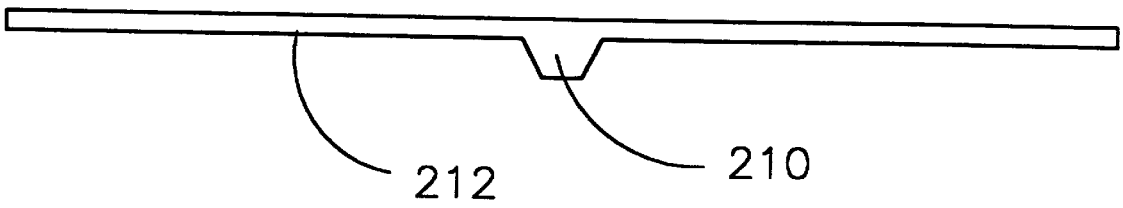
FIG. 19 is a cross-sectional view of the endless conveyor belt shown in FIG. 17 taken along lines 19—19.
Figure 20:
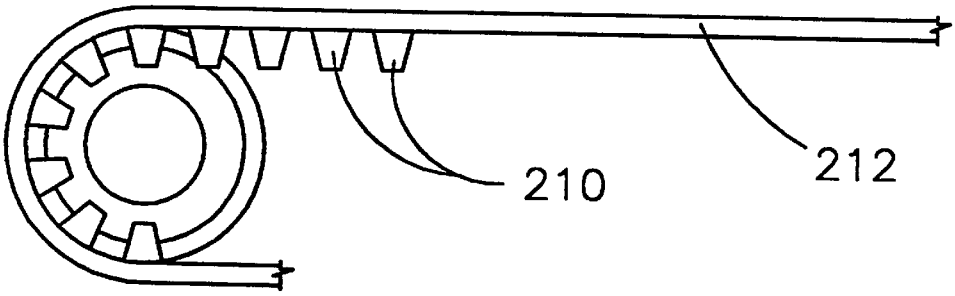
FIG. 20 is a cross-sectional view of the endless conveyor belt shown in FIG. 17 taken along lines 20—20.
Figure 21:
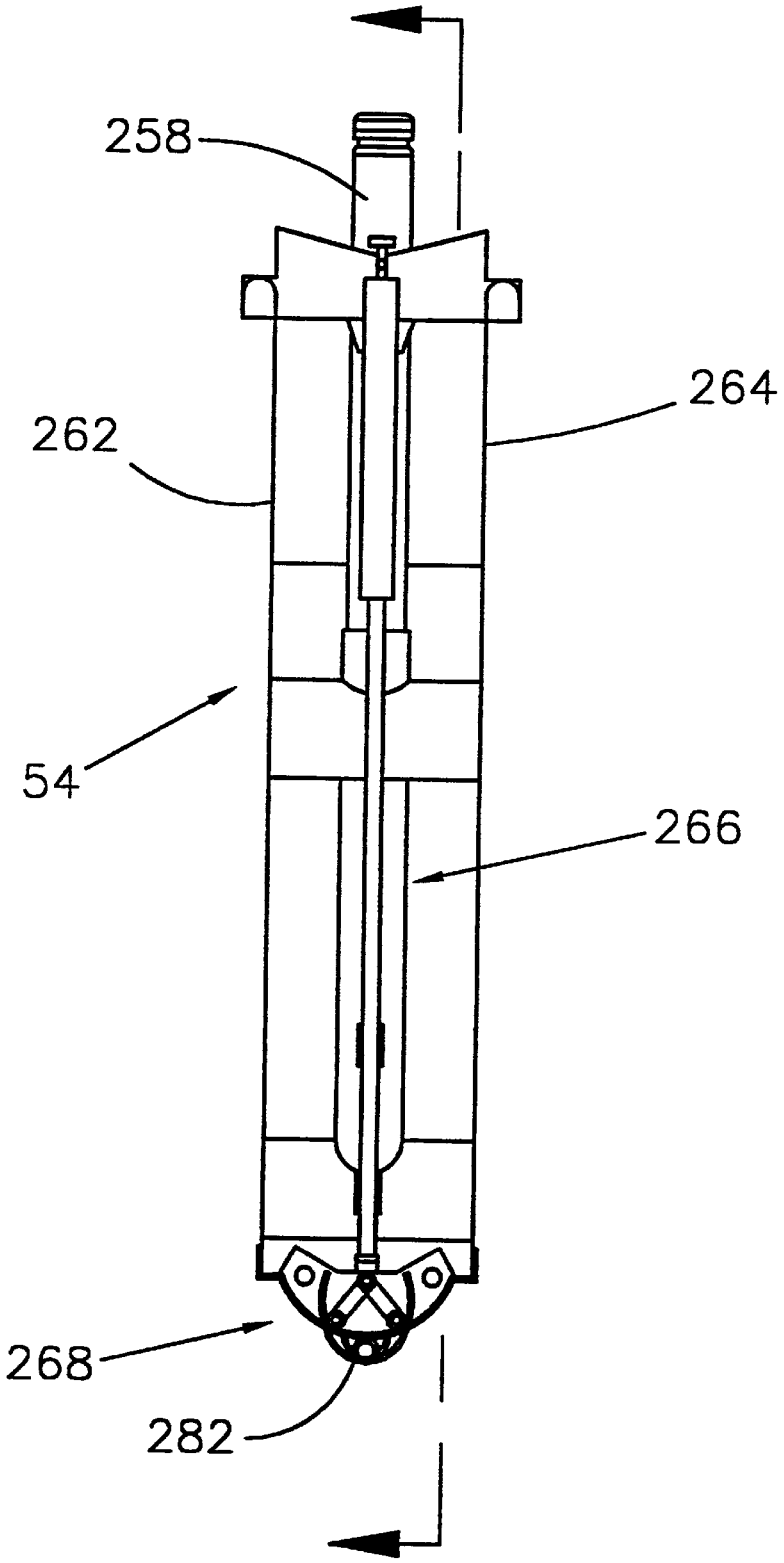
FIG. 21 is a side elevational view of a shoe assembly and an adjustable groover assembly in accordance with the present invention.
Figure 22:
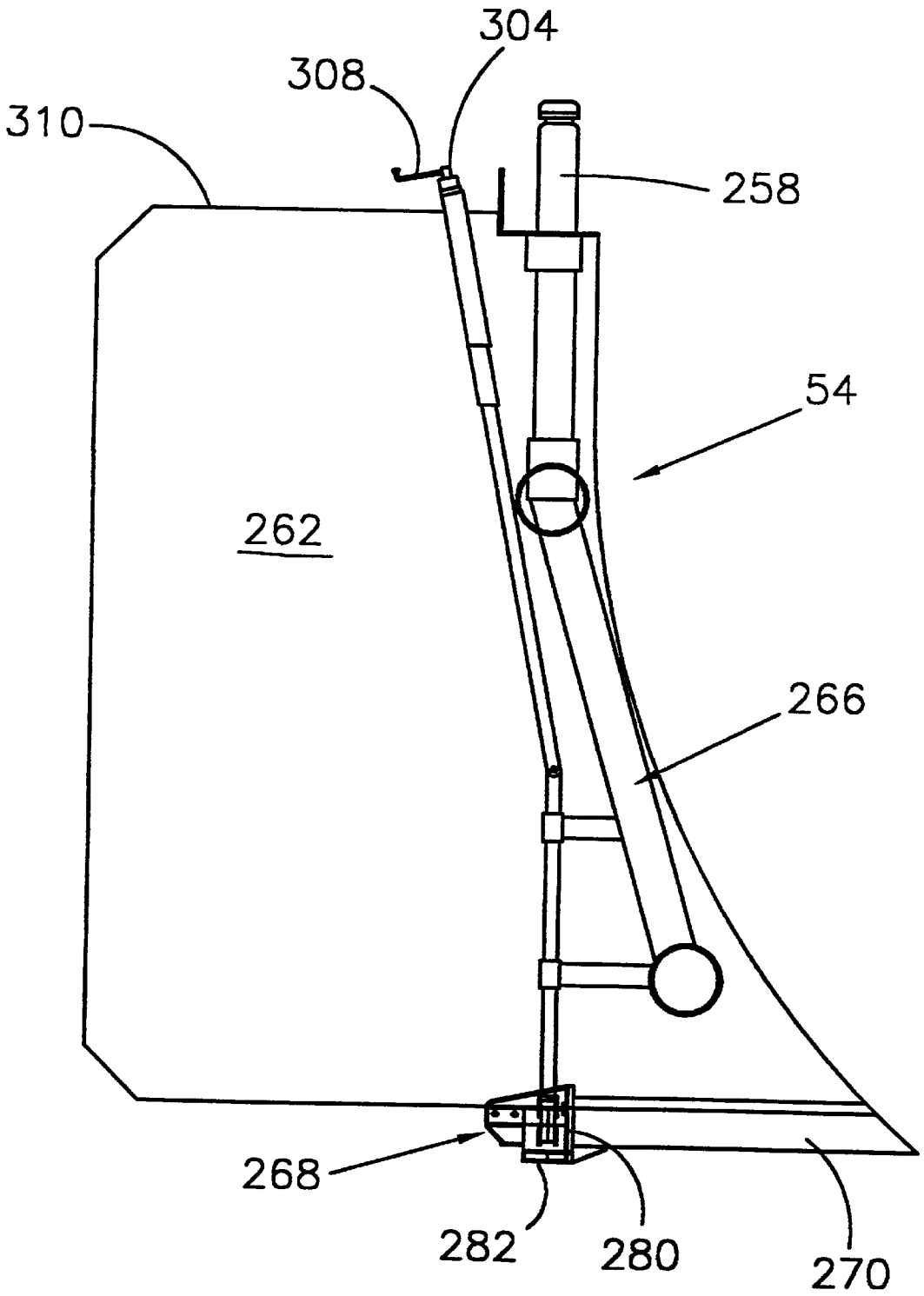
FIG. 22 is a sectional front elevational view of the shoe assembly and the adjustable groover assembly shown in FIG. 21 taken along lines 22—22.
Figure 23:
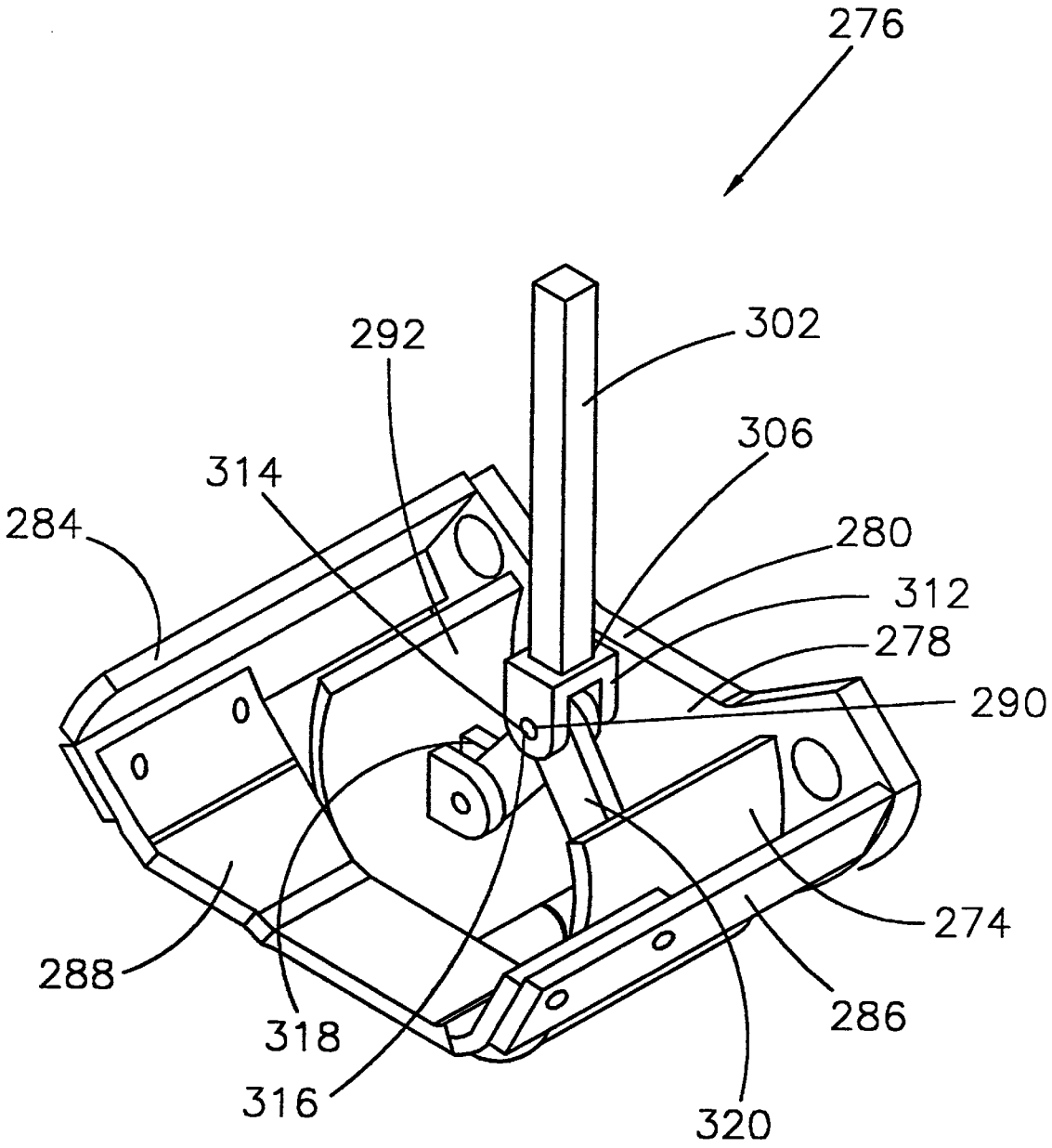
FIG. 23 is a top perspective view taken from the rear of the adjustable groover assembly and a mounting assembly shown in FIG. 21.
Figure 24:
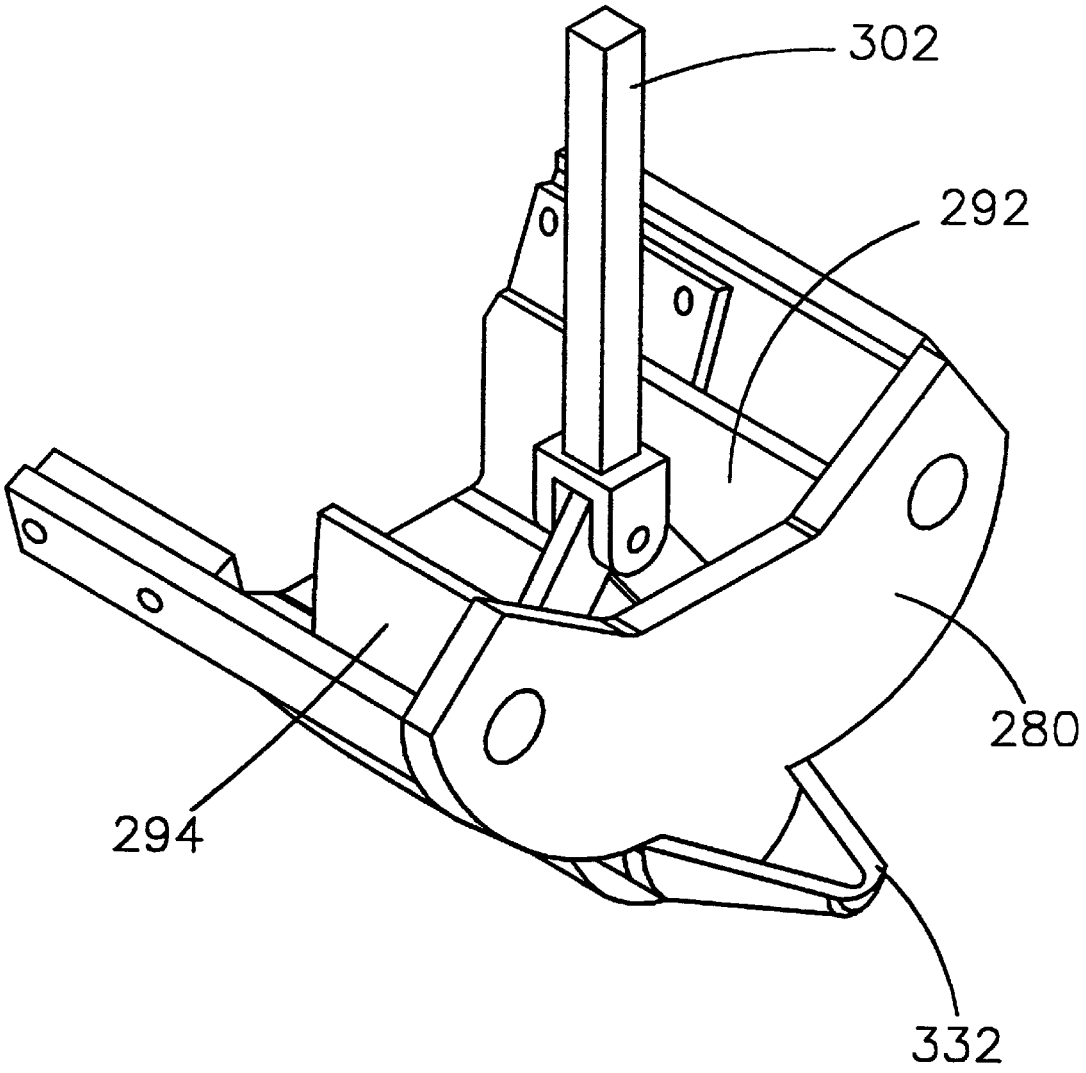
FIG. 24 is a top perspective view taken from the front of the adjustable groover assembly and the mounting assembly shown in FIG. 21.
Figure 25:
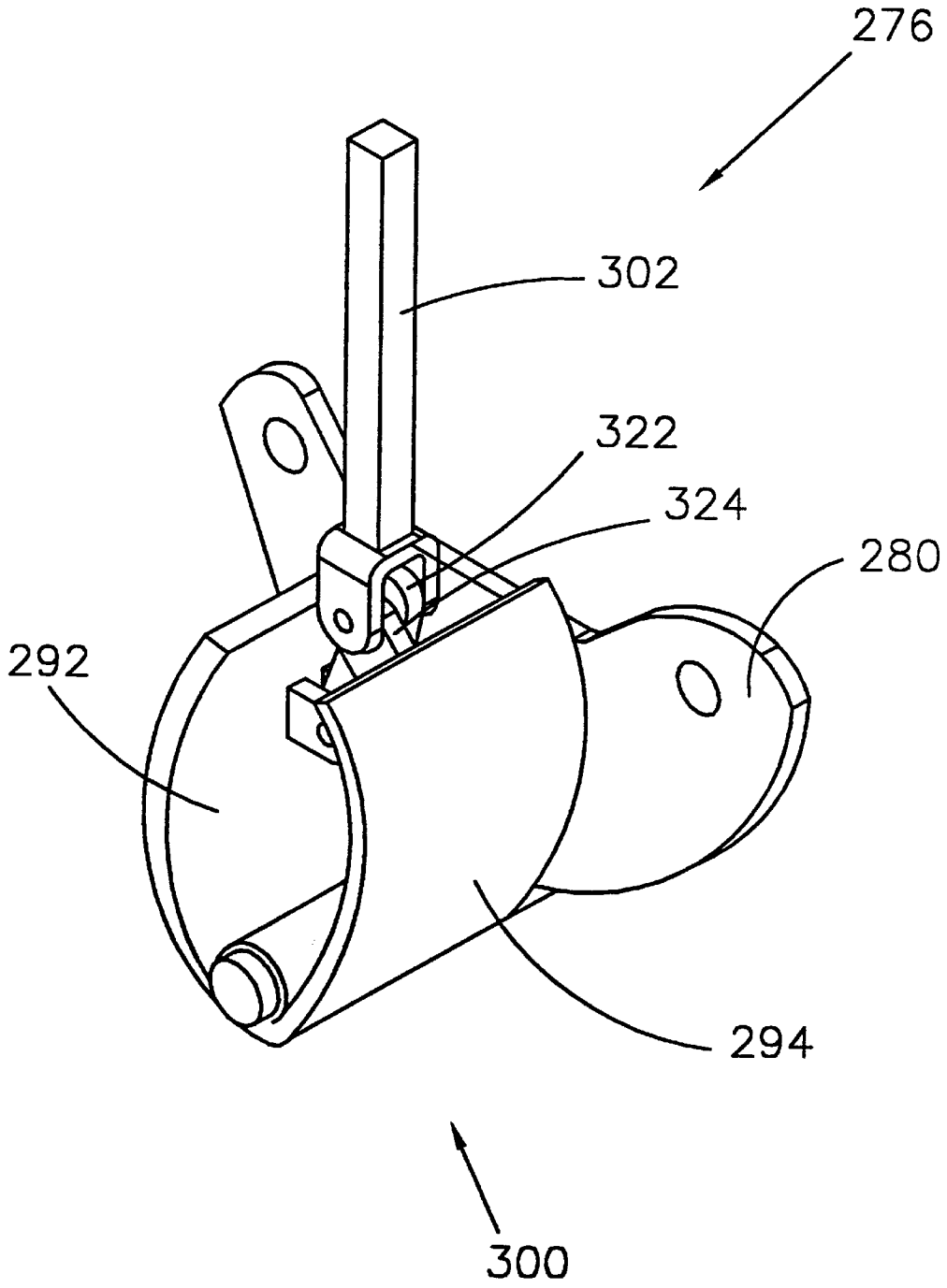
FIG. 25 is a top perspective view taken from the rear of the adjustable groover assembly shown in FIG. 21 in its closed position.
Figure 26:
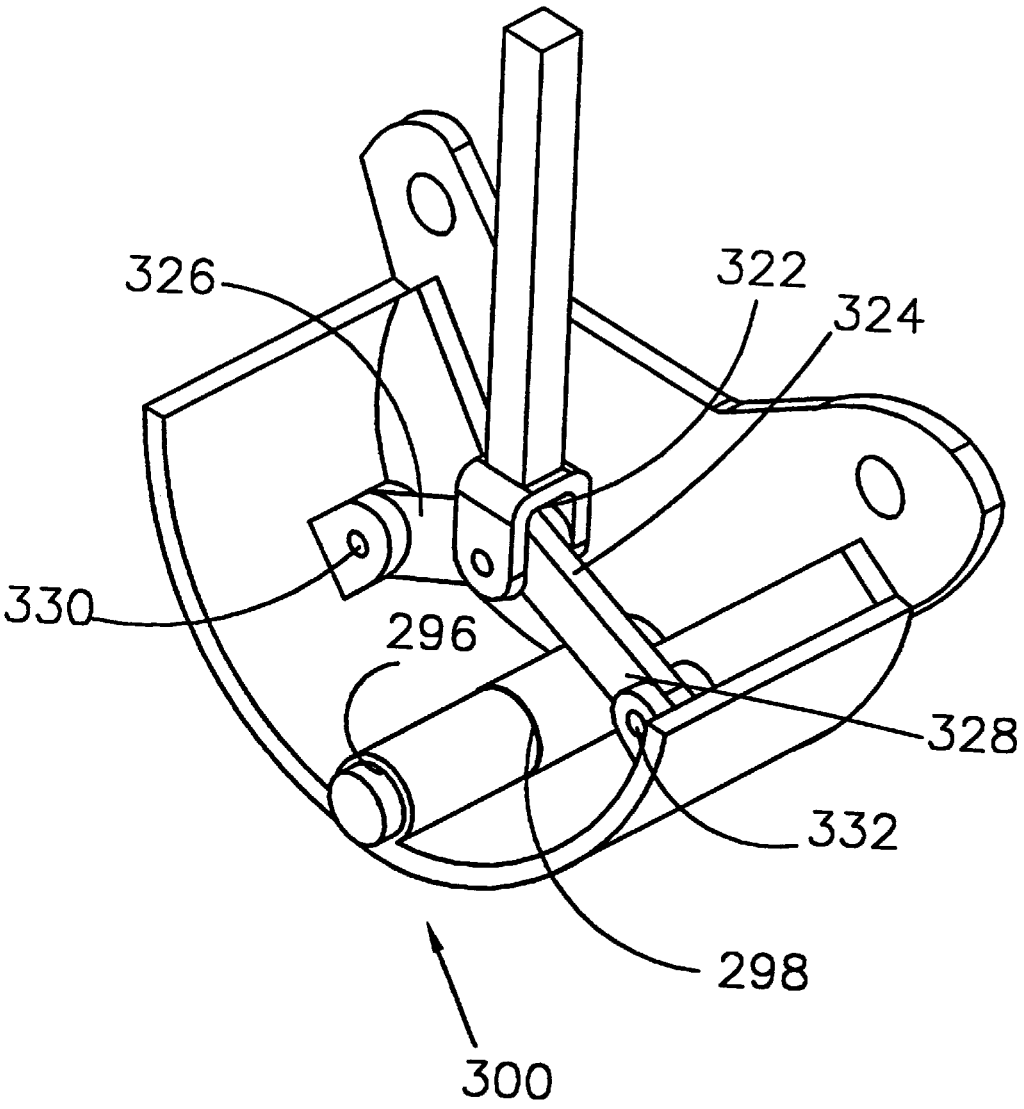
FIG. 26 is a top perspective view taken from the rear of the adjustable groover assembly shown in FIG. 21 in its open position.

An alternative embodiment of the cleaning member 144 is shown in FIG. 16. In this embodiment, a cleaning face 170 is attached directly to a mounting arm 172 which is pivotally mounted to a wheel frame assembly 174 about a horizontal axis 176. A coiled spring 178 is rigidly connected between the mounting arm 172 at 180 and the wheel frame assembly 174 at 182 to provide alternative biasing and retraction means. However, the cleaning face 184 and the ultimate position of the cleaning face 184 within the interior profile 148 of the rim structure 130 and the bucket member 132 would be identical.

Again, while the cleaning member 144 of the present invention is shown on an excavating machine 30 having a bucket wheel trencher assembly 42, it is to be understood that this cleaning member 144 could be sold separately as a retrofit part for existing equipment.

The conveyor assembly of the present invention is shown in FIGS. 17–20. The conveyor assembly 52 is operably attached to the wheel frame assembly 44 in a suspended manner at 186 and 188. This allows the conveyor assembly to be tilted from one side to another depending upon from which side the spoil 140 is to be expelled. The conveyor assembly 52 comprises an interior portion 190 bounded by a first end roller 192 and a second end roller 194 opposite to the first end roller 192, an endless conveyor belt 196 about the first end roller 192 and the second end roller 194, a first side assembly 198 and a second side assembly 200 opposite to the first side assembly 198, all to prevent the spoil 140 from entering the interior portion 190 of the conveyor assembly 52.

The conveyor assembly 52 further comprises a top plate 202 on which the endless conveyor belt 196 slides. In the preferred embodiment, this top plate 202 is made of an ultra-high molecular weight plastic to provide a minimal amount of friction between the endless conveyor belt 196 and the top plate 202. However, it is anticipated that other materials could be used. While the top plate 202 is shown in the preferred embodiment as separate plates 204 and 206 which are located side-by-side with a longitudinal channel 208 therebetween, it is to be understood that a single top plate could also be used having a longitudinal groove therein (not shown). The top plates 204 and 206 of the conveyor assembly 52 extend laterally beyond the first side assembly 198 and the second side assembly 200, respectively, in a manner so as to overlap the side assemblies 198 and 200 to prevent spoil 140 from entering the interior portion 190 of the conveyor assembly 52.

In the preferred embodiment, the endless conveyor belt 196 includes a series of finger-like projections 210 (FIGS. 19 and 20) along its underside 212 corresponding in alignment with the longitudinal channel 208 between the first top plate 204 and the second top plate 206 of the conveyor assembly 52 in order to act in combination as a guide for centering the endless conveyor belt 196 on the conveyor assembly 52. In addition, the first end roller 192 and the second end roller 194 each include an annular groove 214 and 216, respectively, in alignment with the longitudinal channel 208 between the first top plate 204 and the second top plate 206 of the conveyor assembly 52 in order to receive the finger-like projections 210 on the underside 212 of the endless conveyor belt 196 again to center the endless conveyor belt 196 on the conveyor assembly 52. The centering of the endless conveyor belt 196 on the conveyor assembly 52 is also assisted by a tapering of the first end roller 192 and the second end roller 194 wherein the center portion 218 and 220 of the first end roller and second end roller, respectively, is larger in diameter than the end portions 222 and 224 and 226 and 228 of the first end roller 192 and the second end roller 194, respectively.

A belt tension adjuster 230 allows an end member 232 of the first side assembly 198 and an end member 234 of the second side assembly 200, respectively, to be extended or retracted as necessary The tension adjuster 230 comprises a thumb screw 231 which, upon turning, either extends or retracts the end members 232 and 234 of the first side assembly 198 and the second side assembly 200, respectively, along with the second end roller 194. The first end roller 192 is rigidly connected along with end members 238 and 240 of the first side assembly 198 and the second side assembly 200, respectively.

The first side assembly 198 and the second side assembly 200 further includes downwardly extended flanges 242 and 244, respectively, for preventing the spoil 140 from entering the interior portion 190 on the underside 246 of the conveyor assembly 52. For the minimal amount of spoil 140 that does enter the interior portion 190 of the conveyor assembly 52, a plow assembly is operably attached therein to direct the spoil 140 back out from the interior portion 190 of the conveyor assembly 52. The plow assembly is a diamond-shaped configuration of stop plates 250, 252, 254 and 256 which are angled towards the first side assembly 198 and the second side assembly 200. Accordingly, as spoil riding on the underside 212 of the endless conveyor belt 196 comes into contact with the stop plates 250–256 it is directed out of the conveyor assembly 52.

Once again, while the conveyor assembly 52 of the present invention is shown on an excavating machine 30 having a bucket wheel trencher assembly 42, the conveyor assembly 52 could be incorporated with any type of excavating machine having earth cutting means either as original equipment or sold separately as a retrofit part for existing equipment.

The shoe assembly 54 of the present invention is shown in FIGS. 21–26. The shoe assembly 54 includes a post member 258 for operable attachment at 260 with the supporting frame assembly 44. The shoe assembly further includes side plates 262 and 264 for contact with the side walls of the trench 56 in order to prevent a cave-in of the side walls of the trench 56 during use. The side plates 262 and 264 are supported and maintained in a spaced relationship by a tubular support assembly 266 which extends downwardly from the post member 258.

Grooving means 268 are operably attached along the bottom edge 270 of the shoe assembly 54 and extend therebelow to form a groove 272 in the bottom 274 of the trench 56. In the preferred embodiment, the grooving means 268 comprise adjustable groove means 276 for adjusting the radial dimension of the groove 272. The adjustable groove means 276 includes a mounting assembly 278 including a mounting plate 280 rigidly connected to a bottom member 282 of the shoe assembly 54. The mounting assembly 278 of the adjustable groove means 276 also includes side mounting plates 284 and 286 rigidly connected to sidewalls 262 and 264, respectively, of the shoe assembly 54 and a rear mounting plate 288 operably attached between the side mounting plates 284 and 286.

Suspended within the mounting assembly 278 and pivotally connected about a pivot member 290 extended rearwardly from the front mounting plate 280 is the adjustable groover assembly 291 of the adjustable groove means 276. The adjustable groover assembly 291 comprises a first arcuate groove plate 292 and a second arcuate groove plate 294 having apertures 296 and 298, respectively, for receiving the pivot member 290 extended rearwardly from the front mounting plate 280, the first arcuate groove plate 292 and the second arcuate groove plate 294 in combination resulting in an arc 300 of varying radius for forming the groove 272 in the bottom 274 of the trench 56.

Means for pivoting the first arcuate groove plate 292 relative to the second arcuate groove plate 294 are included comprising a linear actuator 302 having a first end 304 and a second end 306 opposite to the first end 304.

The first end 304 of the linear actuator 32 is operably attached to a hand-crank assembly 308 which is operably attached at the top edge 310 of the shoe assembly 54. The second end 306 of the linear actuator 302 is operably attached to a yoke member 312 having an aperture 314 for receiving a pivot member 316 therein. First and second link members 318 and 320 each having a first end 322 and 324, respectively, and a second end 326 and 328, respectively, are pivotally attached at their first ends 322, 324 to the yoke member 312 and at their second ends 324, 326 to the first arcuate groove plate 292 and the second arcuate groove plate 294, respectively, at pivot points 328 and 330, respectively.

Accordingly, as the linear actuator 302 is extended, the link members 318 and 320 extend the first arcuate groove plate 292 and the second arcuate groove plate 294 apart to form a groove of a larger radius. Likewise, when the linear actuator 302 is retracted, the link members 318 and 320 retract the first arcuate groove plate 292 relative to the second arcuate groove plate 294 to create a groove of a smaller radius.

A nose cone member 332 extends in front of the front mounting plate 280 in the direction of travel of the excavating machine 30 to penetrate the ground 58 to make way for the adjustable groover assembly 291.

And again, while the adjustable groover assembly 276 of the present invention is shown on an excavating machine 30 having a bucket wheel trencher assembly 42, it is to be understood that the adjustable groover assembly 276 could be incorporated with any type of excavating machine having earth cutting means as original equipment or sold separately as a retrofit part for existing equipment.

The foregoing description and drawings merely explain and illustrate the invention, and the invention is not limited thereto, except insofar as the claims are so limited as those skilled in the art who have the disclosure before them will be able to make modifications and variations therein without departing from the scope of the invention.

What is claimed is:

1. An excavating machine comprising:

(A) a power unit;

(B) a supporting frame assembly operably attached to said power unit;

(C) earth cutting means operably attached to said supporting frame assembly; and (D) a conveyor assembly operably attached to said supporting frame assembly for expelling from said excavating machine the spoil created by said earth cutting means, said conveyor assembly comprising an interior portion bounded by a first end roller and a second end roller opposite said first end roller, an endless conveyor belt about said first end roller and said second end roller, a first side assembly and a second side assembly opposite said first side assembly, all to prevent said spoil from entering said interior portion of said conveyor assembly, said first and second end rollers having larger diameters at their centers that taper to smaller diameters at their ends.

2. The excavating machine of claim 1, wherein said conveyor assembly further comprises a top plate on which said endless conveyor belt slides.

3. The excavating machine of claim 2, wherein said top plate extends laterally beyond said first side assembly of said conveyor assembly and said second side assembly of said conveyor assembly.

4. The excavating machine of claim 2, wherein said top plate is comprised of ultra-high molecular weight plastic.

5. The excavating machine of claim 1, wherein said conveyor assembly further comprises first and second top plates, said first and second top plates arranged longitudinally side by side leaving a channel running longitudinally therebetween.

6. The excavating machine of claim 5, wherein said first top plate of said conveyor assembly extends laterally beyond said first side assembly of said conveyor assembly and said second top plate of said conveyor assembly extends laterally beyond said second side assembly of said conveyor assembly.

7. The excavating machine of claim 5, wherein said first top plate and said second top plate are comprised of ultra-high molecular weight plastic.

8. The excavating machine of claim 5, wherein said endless conveyor belt includes a series of finger-like projections along its underside corresponding in alignment with said channel between said first and second top plates of said conveyor assembly.

9. The excavating machine of claim 5, wherein said first end roller and said second end roller of said conveyor assembly each include an annular groove corresponding in alignment with said channel between said first and second top plates of said conveyor assembly in order to receive said finger-like projections on said endless conveyor belt.

10. The excavating machine of claim 1, wherein said first side assembly of said conveyor assembly and said second side assembly of said conveyor assembly include means for slidably moving an end roller of said conveyor assembly to adjust the tension of the endless conveyor belt.

11. A conveyor assembly for use on an excavating machine having earth cutting means comprising a conveyor assembly for operable attachment to a supporting frame assembly for expelling from said excavating machine the spoil created by said earth cutting means, said conveyor assembly comprising an interior portion bounded by a first end roller and a second end roller opposite said first end roller, an endless conveyor belt about said first end roller and said second end roller, a first side assembly and a second side assembly opposite said first side assembly, and a first top plate on which said endless conveyor belt slides, all to prevent said spoil from entering said interior portion of said conveyor assembly, said top plate supporting a majority of a transverse section of said endless conveyor belt.

12. The conveyor assembly according to claim 11, wherein said top plate extends laterally beyond said first side assembly of said conveyor assembly and said second side assembly of said conveyor assembly.

13. The conveyor assembly of claim 11, wherein said top plate is comprised of ultra-high molecular weight plastic.

14. The conveyor assembly of claim 11, wherein said conveyor assembly further comprises a second top plate, said first and second top plates arranged longitudinally side by side leaving a channel running longitudinally therebetween.

15. The conveyor assembly of claim 14, wherein said first top plate of said conveyor assembly extends laterally beyond said first side assembly of said conveyor assembly and said second top plate of said conveyor assembly extends laterally beyond said second side assembly of said conveyor assembly.

16. The conveyor assembly of claim 14, wherein said first top plate and said second top plate are comprised of ultra-high molecular weight plastic.

17. The conveyor assembly of claim 14, wherein said endless conveyor belt includes a series of finger-like projections along its underside corresponding in alignment with said channel between said first and second top plates of said conveyor assembly.

18. The excavating machine of claim 14 wherein said first end roller and said second end roller of said conveyor assembly each include an annular groove corresponding in alignment with said channel between said first and second top plates of said conveyor assembly in order to receive said finger-like projections on said endless conveyor belt.

19. The conveyor assembly according to claim 11, wherein said first roller and said second roller are tapered such that they have larger diameters at their centers and smaller diameters at their ends.

20. An excavating machine comprising:

(A) a power unit;

(B) a supporting frame assembly operably attached to said power unit;

(C) earth cutting means operably attached to said supporting frame assembly; and (D) a conveyor assembly operably attached to said supporting frame assembly for expelling spoil created by said earth cutting means from said excavating machine, said conveyor assembly comprising an interior portion bounded by a first end roller and a second end roller opposite said first end roller, an endless conveyor belt about said first end roller and said second end roller, a first side assembly and a second side assembly spaced apart from and opposite said first side assembly, and a top plate extending laterally between said side assemblies to support said endless conveyor belt and substantially cover the space between said side assemblies, all to prevent said spoil from entering said interior portion of said conveyor assembly.

* * * * *